United States Patent [19]

Lombardo

[11] Patent Number: 4,876,814

[45] Date of Patent: Oct. 31, 1989

[54] GUN REST FOR SUPPORTING THE BUTTSTOCK

[76] Inventor: Philip C. Lombardo, P.O. Box 3106, Kirkland, Wash. 98083-3106

[21] Appl. No.: 320,710

[22] Filed: Mar. 8, 1989

[51] Int. Cl.[4] ..... F41C 29/00

[52] U.S. Cl. ..... 42/94

[58] Field of Search ..... 42/94; 89/37.04

[56] References Cited

U.S. PATENT DOCUMENTS

| | | | |
|---|---|---|---|
| 1,089,307 | 3/1914 | Benét | 42/94 |
| 3,041,938 | 7/1962 | Seabrook | 42/94 |
| 4,007,554 | 2/1977 | Helmstadter | 42/94 |
| 4,026,057 | 5/1977 | Cady | 42/94 |
| 4,333,385 | 6/1982 | Culver | 89/37.04 |
| 4,409,751 | 10/1983 | Goda | 42/94 |
| 4,621,563 | 11/1986 | Poiencot | 89/37.04 |

FOREIGN PATENT DOCUMENTS

| | | | |
|---|---|---|---|
| 2255062 | 5/1974 | Fed. Rep. of Germany | 42/94 |

*Primary Examiner*—Charles T. Jordan

[57] ABSTRACT

An improved gun rest characterized by an attaching bracket effectively shaped and dimensioned to secure and support the buttstock of a firearm, and removably mounted thereon. The attaching bracket is pivotally connected to a vertical slide, which can raise or lower in elevation along the length of a vertical support shaft that terminates in a base member on its lowermost end. A recoil dampening pad removably attached to the rear of the gun rest provides protection from the recoil of the most powerful firearm.

The pivotal feature of the attaching bracket can be releasably secured to position the firearm sights perfectly vertical, be they open or telescopic. The vertical slide adjusts for elevation and can also be releasably securted to provide a secure, steady and rigid rear rest for aiming and shooting a firearm, when used in conjuction with the shooters normal front resting procedure.

13 Claims, 3 Drawing Sheets

GUN REST FOR SUPPORTING THE BUTTSTOCK

BACKGROUND

1. Field of Invention

This invention relates to gun rests for firearms, and more particularly, to a portable gun rest, which is used to support the rear buttstock of a gun or rifle when shooting from the benchrest position, and which can be quickly removably mounted to provide a secure and steady rear rest for aiming the gun or rifle at selected elevations, when used in conjunction with the shooters normal front resting procedure.

2. Description of Prior Art

Movement is the nemesis of the benchrest or target shooter. Obtaining the best accuracy is the shooters primary objective, and the least amount of movement is objectionable. Breathing, heartbeat, and the anticipation of the ensuing recoil of the gun or rifle (commonly called flinching), are the primary sources of movement.

Benchrest shooters have for years used a front gun rest to steady the fore-end of the gun or rifle while shooting. The shape of the rest made no deference, anything can, and has been used, from an ammo box, to a sandbag, to the more popular 3 legged rest. Most adjustments are made by the positioning of the shooters shoulder. Stiffening the upper body, along with a few other unsatisfactory techniques is all the benchrest shooter has had at his disposal to try to steady and control the gun or rifle from the buttstock while aiming and shooting.

One such technique employed by benchrest shooters to try and steady a gun or rifle by the buttstock, is to curl the left hand under the butt of the gun or rifle and try to hold the buttstock steady. The obvious drawback to this method is the shooter does not have a hand on the fore-end of the gun or rifle to control it during recoil. This technique has limited adjustment, and no recoil dampening means to help eliminate flinching from the ensuing recoil and is unsatisfactory when shooting the more powerful firearms.

Another unsatisfactory technique employed by benchrest shooters to try and steady a gun or rifle by the buttstock is to rest the buttstock on a sandbag, or rolled up article of clothing. This method has no elevation adjustment, and no recoil dampening means to help eliminate flinching from the ensuing recoil. After every shot the sandbags, or rolled up article of clothing must be readjusted, which is cumbersome and inefficient.

The benchrest shooter has been relying on these and other make do measures from the advent of the sport. He has not had a reliable, efficient and fully adjustable rear rest to support and control the buttstock of a gun or rifle. Gun rests of varying designs have been developed over the years to try and fill this void. The approach of these endeavors is to support the entire firearm in one gun rest. None of which has meet with any acceptance at the shooting range.

One such approach resulted in a gun rest that takes the form of a cradle. The fore-end of the firearm is held in one notch of the cradle, and some part of the buttstock is held in another notch. This type of gun rest does not provide for a locking means to secure the firearm, and its sights, in the proper position for sighting and shooting. Also, it does not provide a full range of adjustment, which is essential to achieve a high degree of accuracy, which is the benchrest shooters primary objective. Nor, does it provide for recoil dampening means to help control flinching, which also helps to improve accuracy. Typical of these types of gun rests are:

U.S. Pat. No. 4,409,751
U.S. Pat. No. 4,055,017

Another approach along the same theme, resulted in an apparatus that is rather large, heavy and cumbersome. It usually supports the firearm either by the fore-end and some part of the buttstock, or by the midsection. This type of gun rest, by its design, is as large or larger than the firearm it is supporting. While some may provide means for locking the firearm in position, they are cumbersome and awkward in there use. Also, they do not provide a recoil dampening means to help control flinching, which helps to improve accuracy. Typical of these types of gun rests are:

U.S. Pat. No. 4,026,057
U.S. Pat. No. 4,012,860
U.S. Pat. No. 4,007,554
U.S. Pat. No. 1,089,307

SUMMARY OF THE INVENTION

The approach of this invention was to develop a gun rest that is lightweight, compact, portable, and positioned to the rear of the buttstock, and holds the gun or rifle perfectly steady, when used in conjunction with the shooters normal front resting procedure. The added convenience and comfort of a recoil dampening pad will help to relieve flinching and the discomfort associated with shooting the powerful firearms of today.

Accordingly, it is an object of this invention to provide a new and improved portable gun rest for firearms which is adjustable, lightweight, and removably mounted to the rear of the buttstock of substantially any firearm.

Yet another object of this invention is to provide a new and improved portable gun rest for substantially any firearm which is characterized by a vertical slide removably mounted to the rear of the buttstock to adjust for elevation, and locking to provide a steady, secure, and rigid rear rest during aiming and shooting of the firearm.

Yet another object of this invention is to provide a new and improved portable gun rest for substantially any firearm which is characterized by a mounting bracket removably mounted to the rear of the buttstock, that pivots to provide adjustment for the vertical positioning of the firearm sights, be they open or telescopic.

yet another object of this invention is to provide a new and improved portable gun rest for substantially any firearm which is characterized by a recoil dampening pad, removably mounted to the rear of the gun rest, permitting the shooter to concentrate on the target without the worry of flinching from the recoil of the firearm.

The added advantage of the recoil dampening pad will be readily recognized when considering the novice shooter who is learning the sport. A gun rest that holds the gun or rifle perfectly steady and eliminates the pain and discomfort from shooting high powered firearms, will enable the novice shooter, as well as the experienced shooter, to concentrate on learning the proper technique and safety skills that will last a lifetime.

Additional objects, advantages, and characteristic features of the present invention will become readily apparent from the following detailed description of the preferred embodiments of the invention when considered in conjunction with accompanying drawings.

DESCRIPTION OF THE PREFERRED EMBODIMENTS

Figure 1:
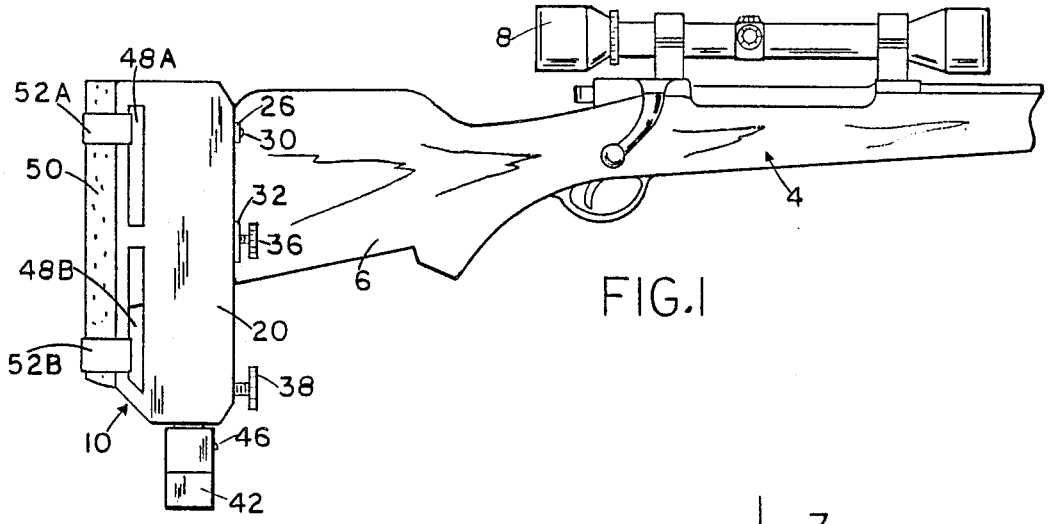
FIG. 1 is a side elevation view of a preferred embodiment of the invention secured to the buttstock of a rifle, with the vertical slide in its lowermost position.
Figure 2:
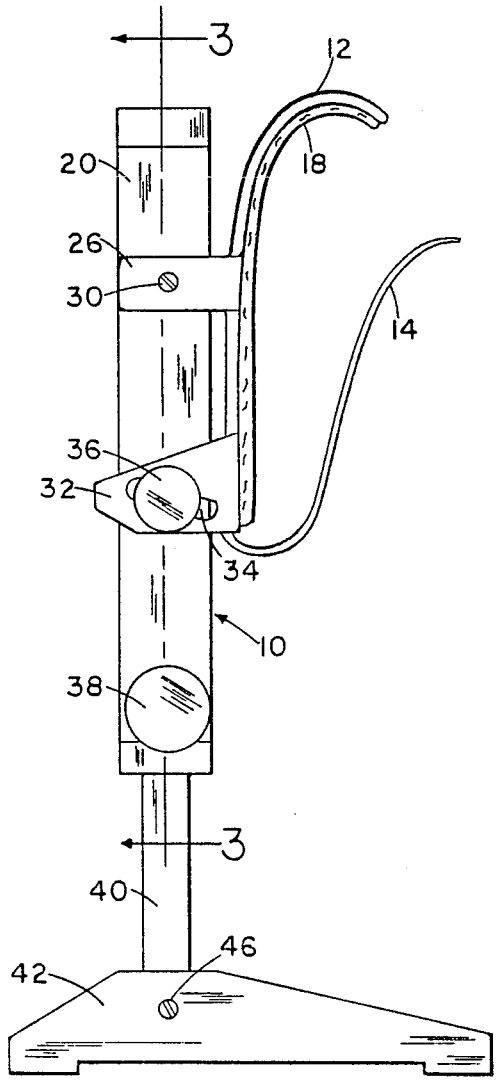
FIG. 2 is a front elevation view of the gun rest of FIG. 1 with the vertical slide in an elevated and locked position.

Referring now to the drawings, and more particularly to FIGS. 1–2, there is shown a gun rest 10 of the present invention mounted to buttstock 6 of rifle 4. The invention broadly illustrated by numeral 10 includes an attaching bracket 12, a vertical slide 20, a vertical support shaft 40, a base 42, and a recoil dampening pad 50.

Referring now to FIGS. 2–4–6 of the drawings, in a preferred embodiment of the present invention attaching bracket 12, is preferably made of metal, and has a substantially inverted J-shape, and dimensioned to receive the buttstock 6 of rifle 4. Attaching bracket 12, has a pivot flange 26 formed at a right angle to its upper front edge, and a locking flange 32 formed at a right angle to its lower front edge (best seen in FIG. 6). A suitable padding material 18, such as leather, or the like inner lines attaching bracket 12 to prevent marring of buttstock 6 of rifle 4. Strap 14, preferably elastic material and of sufficient length to encircle buttstock 6 of rifle 4, has one end permanently affixed to the lower outside surface of attaching bracket 12. Velcro brand fastener 16 is used to releasable secure the free end of strap 14 to the top of attaching bracket 12, when attaching gun rest 10 to buttstock 6 of rifle 4.

Figure 3:
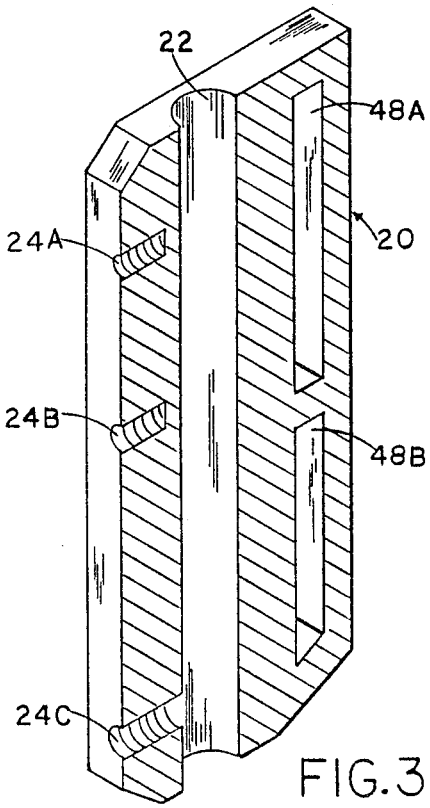
FIG. 3 is a sectional view of the vertical slide taken along line 3—3 in FIG. 2.
Figure 4:
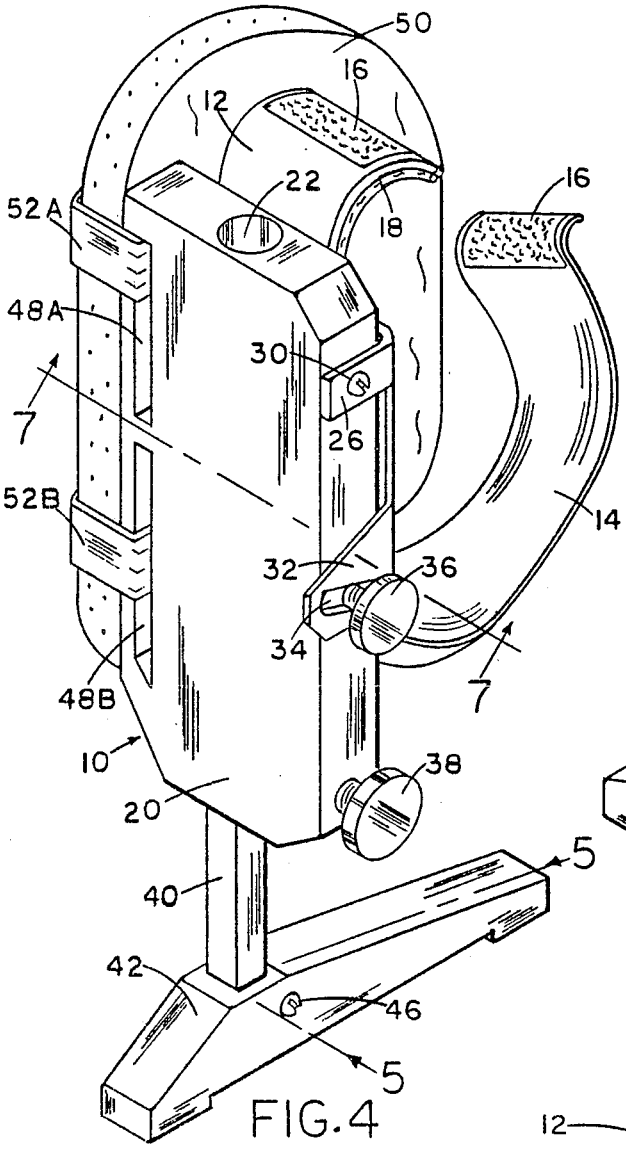
FIG. 4 is a perspective view of the gun rest.

Referring now to FIGS. 2–3–4 of the drawings, vertical slide 20, is preferably made of metal, approximately 7 inches in length, substantially rectangular in shape, and of adequate thickness to receive bore 22 through its entire length, and threaded apertures 24*a-b-c* inwardly from its front surface (best seen in the sectional view of FIG. 3). Vertical slide 20 has slots 48*a-b* positioned along its rear length of adequate dimension to receive straps 52*a-b* therethrough, as will be described presently.

Figure 5:
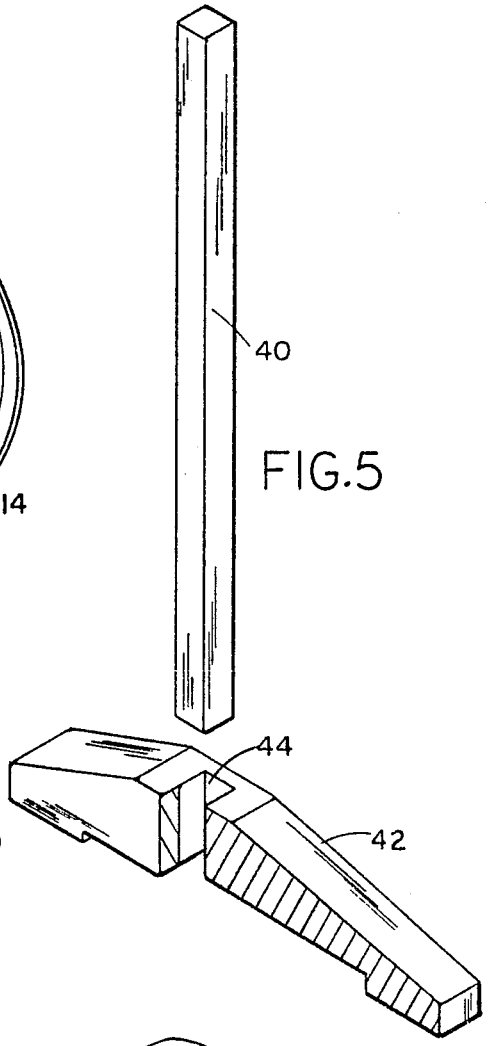
FIG. 5 is a perspective sectional view of the base and vertical support shaft interconnect taken along line 5—5 of FIG. 4.
Figure 7:
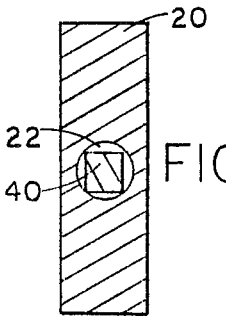
FIG. 7 is a sectional view of the vertical slide, with the vertical support shaft therein taken along line 7—7 in FIG. 4.
Figure 6:
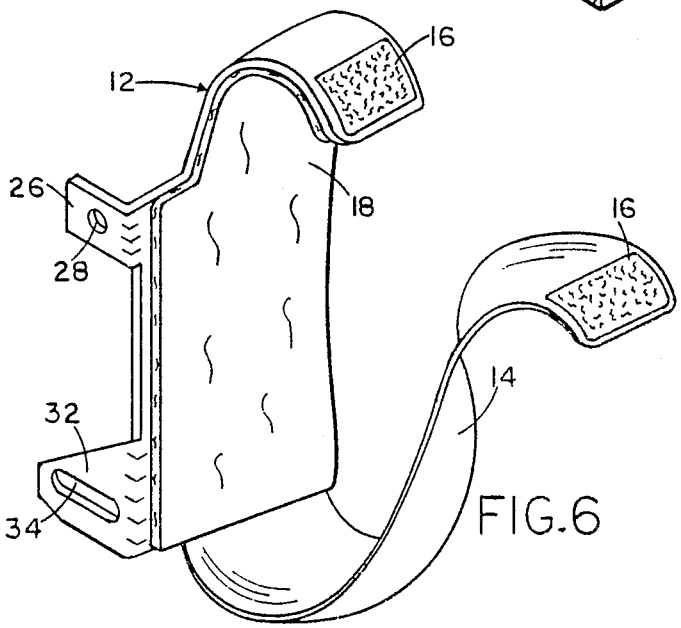
FIG. 6 is an enlarged perspective view of the attaching bracket.

Referring now to FIGS. 2–3–4–6 of the drawings, attaching bracket 12, is pivotally connected to vertical slide 20 by pivot flange 26, which is of sufficient dimension to receive aperture 28 therethrough (best seen in FIG. 6). Aperture 28, is positioned to align with threaded aperture 24*a*, and has sufficient diameter to receive pivot screw 30 therethrough and into threaded aperture 24*a*, to pivotally secure attaching bracket 12 to vertical slide 20.

Locking flange 32, is sufficiently dimensioned to receive pivot slot 34 therethrough (best seen in FIG. 6). Pivot slot 34 is positioned to align with threaded aperture 24*b*, and is of sufficient dimension to permit pivotal adjustment of attaching bracket 12, and to receive pivot lock screw 36 therethrough and into threaded aperture 24*b* to releasably secure the pivotal action of attaching bracket 12.

Referring now to FIG. 5 of the drawings, vertical support shaft 40 is an elongated metallic member about 8 inches in length, and square in its cross section. The lowermost end of vertical support shaft 40 interconnects with base 42, by way of square hole 44, and secured by set screw 46, which inserts into a threaded aperture (not characterized). Base 42, is perferably made of metal and of sufficient dimension to support gun rest 10.

Referring now to FIGS. 2–3–4–7 of the drawings, vertical support shaft 40 inserts into bore 22 of vertical slide 20 (best seen in the sectional view of FIG. 7), and permits vertical slide 20 to raise and lower over the length of vertical support shaft 40. Threaded aperture 24*c* extends into bore 22 (best seen in the sectional view of FIG. 3), permitting lockscrew 38 to abut vertical support shaft 40, thus, releasably securing vertical slide 20 at desired elevation along the length of vertical support shaft 40.

Referring now to FIGS. 1–4 of the drawings, recoil dampening pad 50, is preferably made of a resilient material and sufficiently shaped and dimensioned to provide protection, to the shooter, from the recoil of rifle 4. Recoil dampening pad 50 is releasably secured to gun rest 10 by straps 52*a-b* through slots 48*a-b* in vertical slide 20 and through slots (not characterized) in recoil dampening pad 50. A suitable fastener (not characterized) is used to hold straps 52*a-b* in place.

Figure 8:
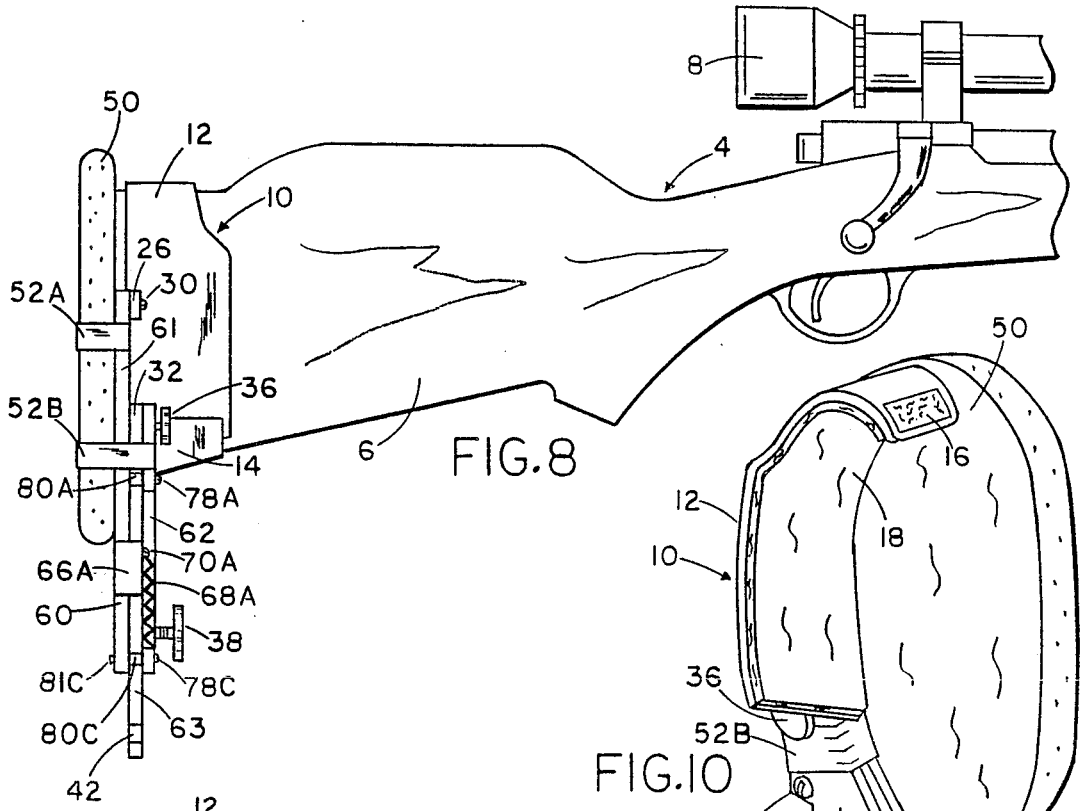
FIG. 8 is a side elevation view of another preferred embodiment of the invention secured to the buttstock of a rifle.

Referring now to FIGS. 8–9–10–11 of the drawings, and more particularly to FIG. 8, there is shown another preferred embodiment of gun rest 10 of the present invention mounted to buttstock 6 of rifle 4. The embodiment of this invention is broadly illustrated by numeral 10, and includes an attaching bracket 12, a vertical support assembly comprising, a main frame 60, front frame 62, a telescopic slide 63, and a base 42.

Figure 11:
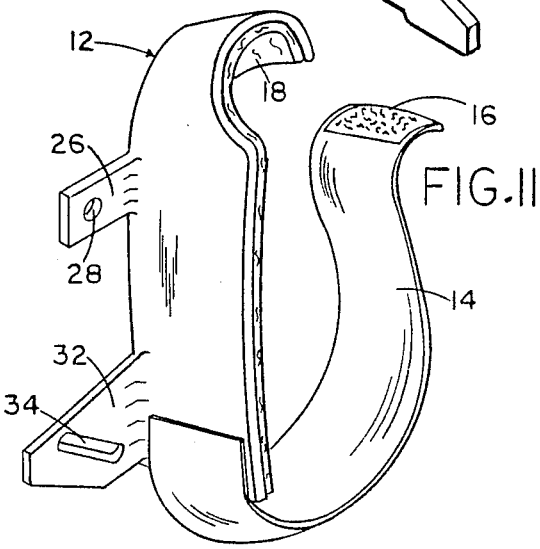
FIG. 11 is a enlarged perspective view of the attaching bracket.

Referring now to FIG. 11 of the drawings, attaching bracket 12, is preferably made of metal, and has a substantially inverted J-shape, and dimensioned to receive buttstock 6 of rifle 4. Attaching bracket 12 has a pivot flange 26 formed at a right angle to its upper back edge, and a locking flange 32 formed at a right angle to its lower back edge (best seen in FIG. 11). A suitable padding material 18, such as leather, or the like inner lines attaching bracket 12 to prevent marring buttstock 6 of rifle 4. Strap 14, preferably elastic material, and of sufficient length to encircle buttstock 6 of rifle 4, has one end permanently attached to the lower outside surface of attaching bracket 12. Velcro brand fastener 16 is used to releasably secure the free end of strap 14 to the top of attaching bracket 12, when attaching gun rest 10 to buttstock 6 of rifle 4.

Figure 10:
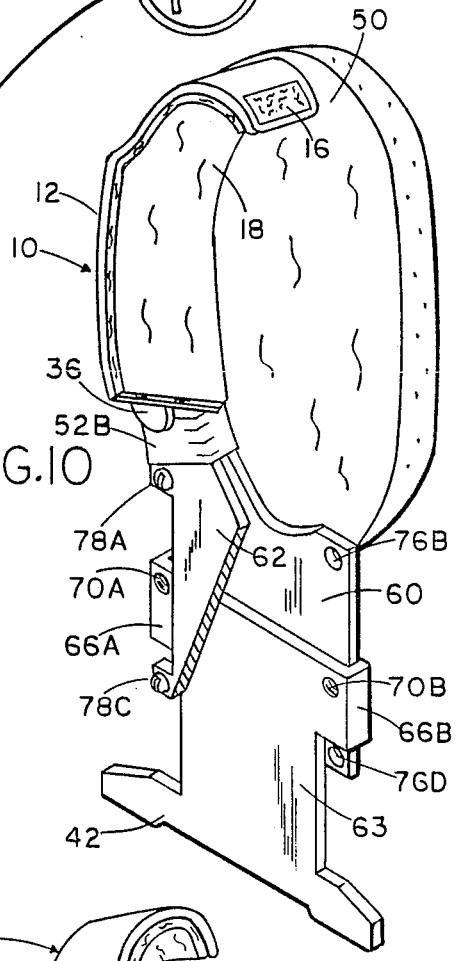
FIG. 10 is a perspective sectional view of the gun rest with the telescopic slide in a deployed position taken along lines 10—10 of FIG. 9.
Figure 9:
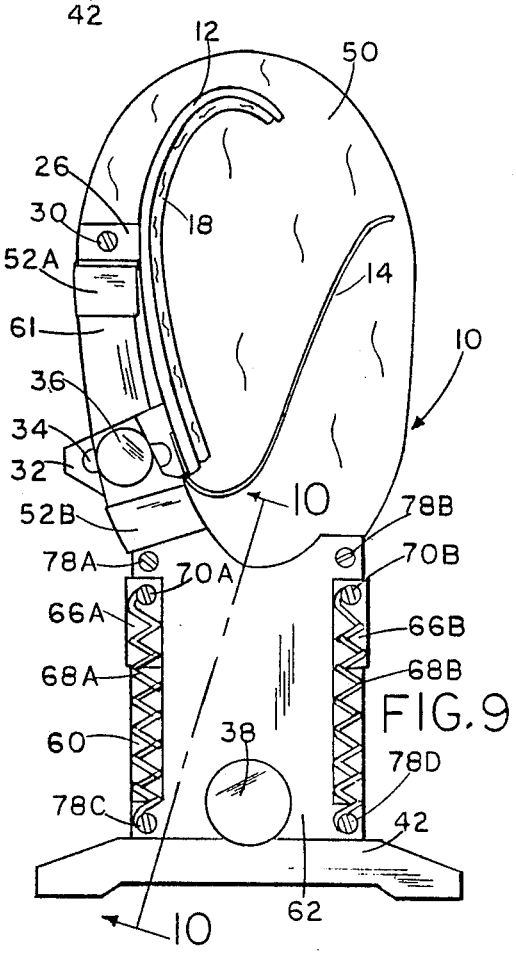
FIG. 9 is a front elevation view of the gun rest of FIG. 8 with the telescopic slide in a retracted position.

Referring now to FIGS. 8–9–10 of the drawings, main frame 60, is preferably made of metal, and has a substantially flat and rectangular shape with an elongated member 61 on the left side of the top half (best seen in FIG. 9). Main frame 60 is spaced in parallel with front frame 62, (best seen in FIGS. 8–10) with spacers 80*a-b-c-d* (80*b-d* not characterized). Front frame 62, is preferably made of metal, and shaped substantially as main frame 60, with suitable apertures (not characterized) to permit the registration of frame screws 78*a-b-c-d* through frame spacers 80*a-b-c-d* (80*b-d* not characterized) and through apertures 76*a-b-c-d* in main frame 60 (76*a-c* not characterized) with suitable locknuts (not characterized).

Referring now to FIGS. 8–9–10–11 of the drawings, attaching bracket 12 is pivotally attached to the top of elongated member 61 of main frame 60 (best seen in FIG. 9) by pivot flange 26, which is of sufficient dimension to receive aperture 28 therethrough (best seen in FIG. 11). Aperture 28 is positioned to align with an aperture (not characterized) in elongated member 61 of main frame 60, and has sufficient diameter to receive pivot screw 30 therethrough to register with a locktnut (not characterized), in order to pivotally secure attaching bracket 12 to elongated member 61 of main frame 60.

Referring again to FIGS. 8–9–10–11 of the drawings, locking flange 32 is sufficiently dimensioned to receive pivot slot 34 therethrough (best seen in FIG. 11). Pivot slot 34 is positioned to align with a threaded aperture (not characterized) in main frame 60, and is of sufficient dimension to permit pivotal adjustment of attaching bracket 12. Lock screw 36 passes through an aperture (not characterized) in front frame 62, through pivot slot 34, and into a threaded aperture (not characterized) in main frame 60, in order to releasably secure the pivotal action of attaching bracket 12.

Referring now to FIGS. 9–10 of the drawings, and more particularly to the sectional view of FIG. 10, telescopic slide 63, is preferable made of metal and housed between front frame 62, and main frame 60. Telescopic slide 63 has guides 66*a-b* formed at right angles to the upper edge of each side, keeping telescopic slide 63 in vertical alignment with main frame 60. The lowermost end of telescopic slide 63 forms a base 42, of sufficient dimension to support gun rest 10. Lock screw 38, which registers with a threaded aperture (not characterized) in front frame 62 locks telescopic slide 63 at desired elevations along its length. Springs 68*a-b* are secured to guides 66*a-b* by screws 70*a-b*, which register with threaded apertures 72*a-b* in guides 66*a-b*, and to the bottom of front frame 62, by screws 78*c-d* (best seen in FIG. 9).

Referring now to FIGS. 8–9–10 of the drawings, recoil dampening pad 50, is preferably made of a resilient material, and sufficiently shaped and dimensioned to provide protection, to the shooter, from the recoil of rifle 4. Recoil dampening pad 50 is releasably secured to gun rest 10 by straps 52*a-b*. Straps 52*a-b* encircle elongated member 61 of main frame 60, pass through slots (not characterized) in recoil dampening pad 50. A suitable fastener (not characterized) holds straps 52 *a-b* in place.

Operation of Gun Rest

The gun rest 10 of FIGS. 1–8 is capable of steadying a firearm in a variety of shooting situations including, bench rest target shooting, prone on the ground target shooting, and also can be used effectively in the field varmint shooting. However users will find it most useful from the bench rest position, when used in conjunction with the shooters normal front resting procedure.

Accordingly, the shooter would fit attaching bracket 12, as in FIGS. 1–8, over the rear buttstock 6 of rifle 4, and secure it by stretching elastic strap 14 around buttstock 6 of rifle 4, and fasten it to the top of attaching bracket 12, with velcro brand fastener 16. By pivoting attaching bracket 12 to the right or left, telescopic sight 8, or open sights, can be adjusted perfectly vertical for sighting and shooting, and temporarily locked in place by lock screw 36.

The shooter would now adjust gun rest 10, and rifle 4 to the proper elevation. In the embodiment of FIG. 1, the shooter would loosen lock screw 38, and by lifting up or pushing down on buttstock 6 of rifle 4, position the vertical slide 20 along the length of vertical support shaft 40 to the desired elevation, and temporarily lock it in place by tightening lock screw 38.

In the embodiment of FIG. 8, the elevation is adjusted by loosening lock screw 38 and sliding the telescopic slide 63 in or out of its housing, by lifting up or pushing down on buttstock 6 of rifle 4, and temporarily locking it in place by tightening lock screw 38.

Gun rest 10, and rifle 4 are now in the proper configuration for sighting and shooting. The shooter would now place his shoulder against recoil dampening pad 50, and align himself with rifle 4 as he normally would for sighting and shooting.

Furthermore, the invention in both of its design embodiments provides a highly reliable, lightweight, and efficient gun rest, which can be used by persons of almost any age, to hold and control a firearm for sighting and shooting, while the recoil dampening pad 50 provides protection, to the shooter, from the recoil of even the most powerful firearms.

While my above description contains many specificities, these should not be construed as limitations on the scope of the invention, but rather as an exemplification of the preferred embodiments thereof. Many other variations are possible. For example, skilled artisans will readily be able to change the dimensions and shape of the various embodiments. They will be able to make gun rest 10 of alternative materials, such as plastic, fiberglass, wood, and some of the more exotic composite materials available today. They can make vertical support shaft 40 (as in the embodiment of FIG. 1) round, triangular, rectangular, or use a plurality of shafts.

In the embodiment of FIG. 8, skilled artisans could make gun rest 10 without springs 68*a-b*. They could make gun rest 10 without front frame 62, in which case telescopic slide 63 could have a vertical slot to permit lock screw 38 to register with a threaded aperture in main frame 60 to releasably secure telescopic slide 63 at the desired elevations. They could make attaching bracket 12 (as in the embodiments of FIGS. 1–8) non pivoting. The pivotal adjustment could be accomplished by base 42 being pivotally attached.

Accordingly, the scope of the invention should be determined not by the embodiments illustrated, but by the appended claims and their legal equivalents.

Having described the present invention, what I claim as new is:

1. A portable and pivotally adjustable gun rest for supporting and controlling a buttstock of a firearm comprising:

a vertical support assembly including a generally horizontal rigid base disposed transversely to the general orientation of said firearm, having top and bottom surfaces, and front and rear sides, and an upwardly extending elongated support member issuing from and rigidly affixed to the uppermost surface of said base and effectively shaped and dimensioned to provide a rigid and secure vertical support, a vertical slide substantially rectangular in its cross section and of sufficient dimension to receive an aperture through its vertical length and cooperatively interconnected with said elongated support member through said aperture, enabling said vertical slide to raise and lower in elevation, a lock screw for releasably securing said vertical slide at desired elevations along the length of said elongated support member, and means issuing from and aligned to the rear of said vertical slide to facilitate the removable attachment of a recoil dampening pad so as to remain in the proper alignment during the pivotal adjustment and vertical adjustment of said gun rest, a pivotally adjustable attaching bracket effectively shaped, dimensioned and contoured to secure and support said buttstock in an adjusted and controlled position, fastening means affixed to at least one end of said attaching bracket to facilitate the removable attachment from said attaching bracket to said buttstock, pivotally connecting means issuing from at least one edge of said attaching bracket and effectively positioned to pivotally connect said attaching bracket to said vertical slide, and releasable securing means issuing from at least one edge of said attaching bracket effectively shaped and positioned to releasably secure the pivotal motion from said attaching bracket to said vertical slide, whereby said firearm can be pivoted from side to side adjusting the firearm sights, be they open or telescopic, perfectly vertical for the proper eye to sight alignment regardless of the contour of said buttstock, forming a secure, portable and fully adjustable rear gun rest for sighting and shooting.

2. The invention of claim 1 wherein said vertical slide has an upper threaded aperture extending inwardly from its front surface.

3. The invention of claim 1 wherein said pivotally connecting means from said attaching bracket to said vertical slide is a pivot flange.

4. The invention of claim 3 wherein said pivot flange is positioned at a right angle to said attaching brackets upper front edge and of sufficient dimension to receive an aperture therethrough, and positioned to align with said upper threaded aperture in said vertical slide and pivotally connected with a suitable fastener.

5. The invention of claim 1 wherein said vertical slide has a middle threaded aperture extending inwardly from its front surface.

6. The invention of claim 1 wherein said means for releasably securing the pivotal motion of said attaching bracket is a locking flange and a lock screw.

7. The invention of claim 6 wherein said locking flange is positioned at a right angle to said attaching brackets lower front edge and of sufficient dimension to receive a pivot slot therethrough and positioned to align with said middle threaded aperture in said vertical slide and the pivotal motion being releasably secured with said lock screw.

8. The invention of claim 1 wherein said vertical slide has a lower threaded aperture extending inwardly from its front surface.

9. The invention of claim 1 wherein said fastening means for removable attachment from said attaching bracket to said buttstock is a strap preferable made of an elastic type material of sufficient dimension to encircle said buttstock.

10. The invention of claim 8 wherein said lower threaded aperture is positioned to interconnect with said lock screw for releasably securing said vertical slide at desired elevations along the length of said elongated support member.

11. The invention of claim 1 wherein said attaching bracket is lined with a suitable padding material such as leather to prevent marring of said buttstock.

12. The invention of claim 1 wherein said lock screw is of a thumbscrew type.

13. The invention of claim 1 wherein said means for the removable attachment from said vertical slide to said recoil dampening pad comprises a plurality of elongated slots aligned vertically to the rear of said vertical slides side surface and extending therethrough, and a plurality of straps extending from said recoil dampening pad through said slots.

* * * * *